US006256796B1

(12) United States Patent
Fleming

(10) Patent No.: US 6,256,796 B1
(45) Date of Patent: Jul. 10, 2001

(54) NOVELTY CAP HAVING FAN-LIKE STRUCTURE

(75) Inventor: Ward Fleming, Greene County, NY (US)

(73) Assignee: Fan Hats LLC, Wolfeboro, NH (US)

( * ) Notice: Subject to any disclaimer, the term of this patent is extended or adjusted under 35 U.S.C. 154(b) by 0 days.

(21) Appl. No.: 09/693,089

(22) Filed: Oct. 20, 2000

(51) Int. Cl.[7] ..... A42B 1/24

(52) U.S. Cl. ..... 2/209.13; 2/244

(58) Field of Search ..... 2/209.13, 244, 2/200.3; 446/27, 487

(56) References Cited

U.S. PATENT DOCUMENTS

| | | | | |
|---|---|---|---|---|
| Re. 17,064 | * | 8/1928 | Fischer | 2/209.13 |
| D. 182,999 | * | 6/1958 | Glass | D3/13 |
| 3,026,525 | * | 3/1962 | Gyorfy | 2/209.13 |
| 5,903,926 | * | 5/1999 | Fleming | 2/209.13 |

* cited by examiner

*Primary Examiner*—Bibhu Mohanty
(74) *Attorney, Agent, or Firm*—Howard C. Miskin; Gloria Tsui-Yip

(57) ABSTRACT

A novelty cap is provided having a strip of fabric with an accordion folding defined by a plurality of pleated fin-like members. The strip can be made to close or open to a fanlike structure while mounted on top of the head of a wearer. The rearmost fin is weighted, i.e., comprises a metal bar which serves to keep the fan-like structure in fully opened position.

12 Claims, 4 Drawing Sheets

NOVELTY CAP HAVING FAN-LIKE STRUCTURE

FIELD OF THE INVENTION

This invention relates generally to a novelty device and is particularly related to a novelty cap or hat having a fan-like structure mounted on the cap, which can be readily opened and closed as desired. The fan novelty cap not only attracts attention but also has entertaining, promotional and marketing values.

BACKGROUND OF THE INVENTION

Various novelty hats are available and have been used for the purpose of attracting attention or for promotional and marketing purposes in the fields of sports and social or political activities. One such novelty hat is described in U.S. Pat. No. 5,903,626 issued May 18, 1999 to Ward Fleming, the inventor named in the present application. The hat described in said patent has a dome-shaped body, e.g., a cap, that fits over the head of the wearer, and a fan-like structure pivotally attached to at least three points, i.e., the front end, the rear end and the center of the dome-shaped body as shown therein in FIGS. 2 and 3. The fan-like structure itself is formed of a strip of fabric having an accordion folding. In its closed position, the accordion folding rests on the dome-shaped body and is attached to the surface of the dome-shaped body by various methods or means, such as by adhesive, sewing or stapling, taping, Velcro®, and the like. The disclosure of said patent is fully incorporated herein by reference.

The present invention provides a novelty cap with a fan-like structure which varies in its construction from the novelty hat described in said patent, and which may also be used for the purpose of attracting attention, or for promotional and marketing purposes. The novelty hat of the present invention constitutes a variation from and/or improvement over the heretofore-used novelty hats, including the novelty hat described in the aforementioned patent.

SUMMARY OF THE INVENTION

The present invention provides a novelty device having a fan-like structure pivotally mounted at the top of a dome-shaped body, e.g., a cap, to create a pivot point at the rear of the cap. The fan-like structure is formed by a strip of fabric having an accordion folding defined by a plurality of fin-like members pivotally attached at the rear end of the cap. In closed position, the strip rests conformally on top of the cap. When the person wearing the cap tilts his or her head backward, the accordion folding opens into a fan-like structure. The bottom most fin-like member is weighted, i.e., is provided with a weight such as, e.g., a metal bar, which serves to maintain the fan-like structure in fully open position. It may be returned to its closed position by hand or by bending the head forward to counteract the effect of the weighted fin-like member. If desired, the cap with the fan-like structure mounted thereon can be worn in combination with a mask, such as a mask used for Halloween or at Mardi Gras. Moreover, the fan-like structure may be mounted on a backpack or a bag with sewn in zip pockets designed to releasably retain the fan-like structure.

The fan-like structure may bear a slogan or promotional material which becomes visible when the structure is in open position.

The dome-shaped body on which the fan-like structure can be mounted is not limited to hats and caps, but may be an attachment to an eraser that fits on the end of a pencil.

BRIEF DESCRIPTION OF THE DRAWINGS

In the drawings, wherein like reference numerals are employed to designate like parts.

DETAILED DESCRIPTION OF THE PREFERRED EMBODIMENT OF THE INVENTION

In the ensuing description, the present invention will be illustrated and described with reference to a dome-shaped body of particular construction, i.e., a cap of the type worn by some men in the armed forces of the United States. It must be understood, however, that the fan-like structure described herein is not limited in use with such caps but, in general, can be used for similar purposes on other dome-shaped devises as well.

Figure 1:
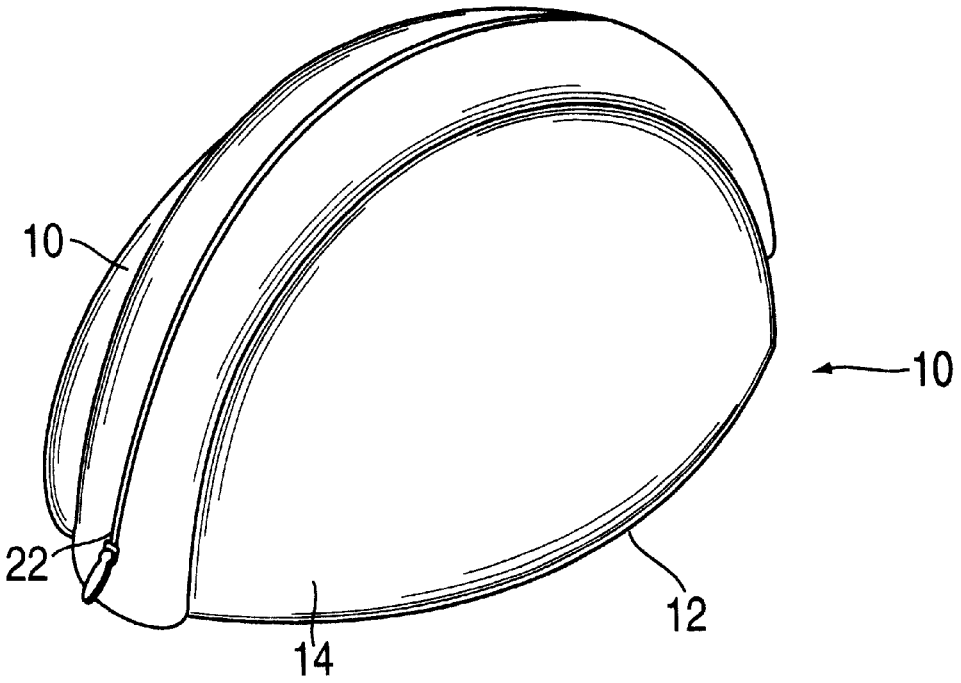
FIG. 1 is a perspective view of a cap used with a fan-like structure in accordance with this invention.
Figure 2:
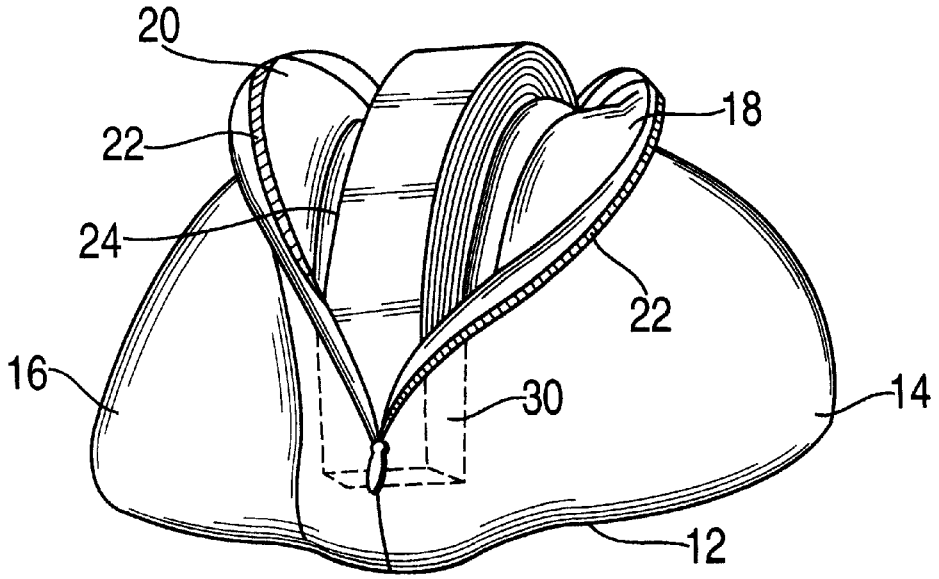
FIG. 2 is a perspective view of the cap shown in FIG. 1, with top of the cap in open position.
Figure 3:
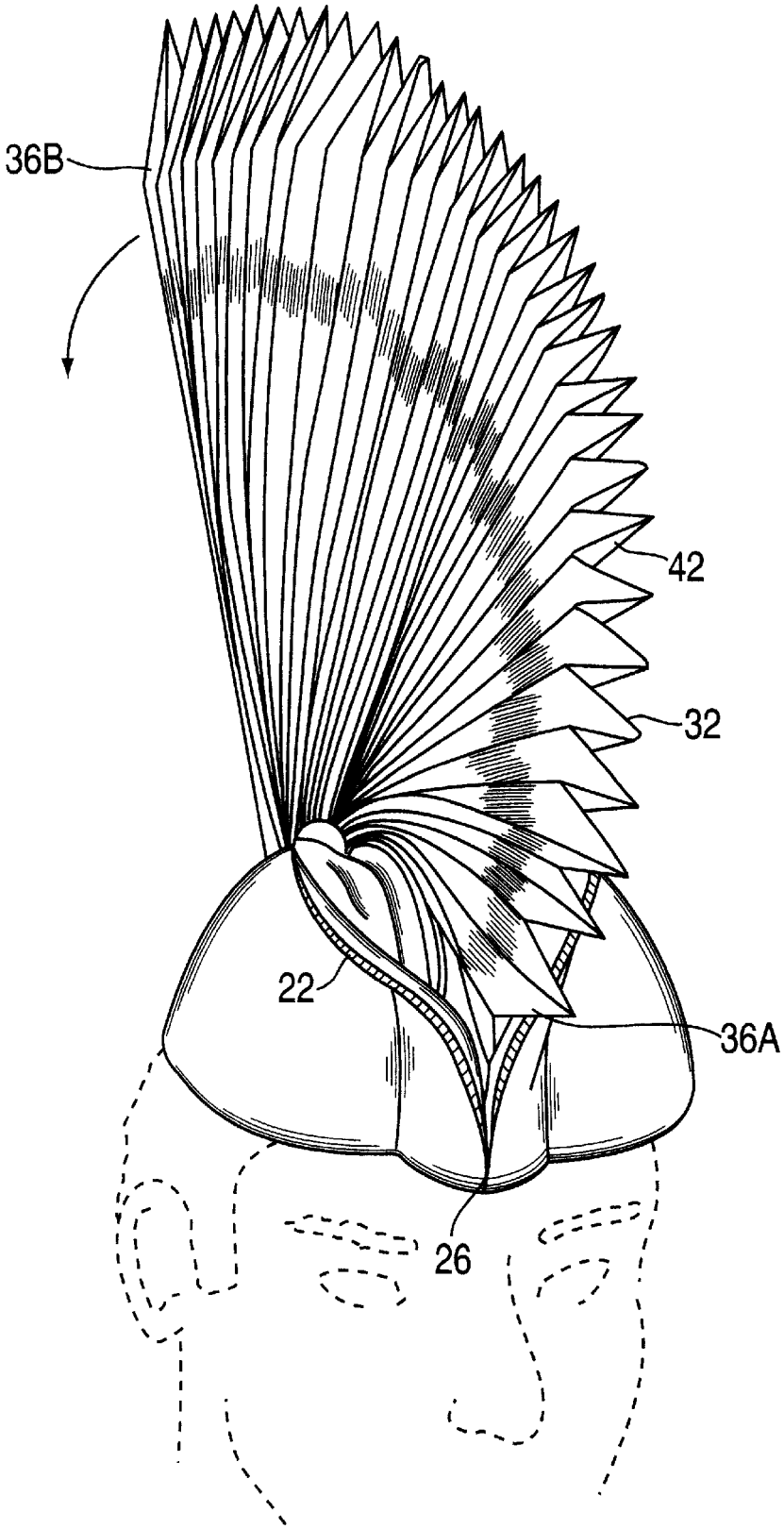
FIG. 3 is a perspective view of the cap shown in FIG. 2, on a wearer's head, with the fan-like structure attached thereto, in partly open position.
Figure 4:
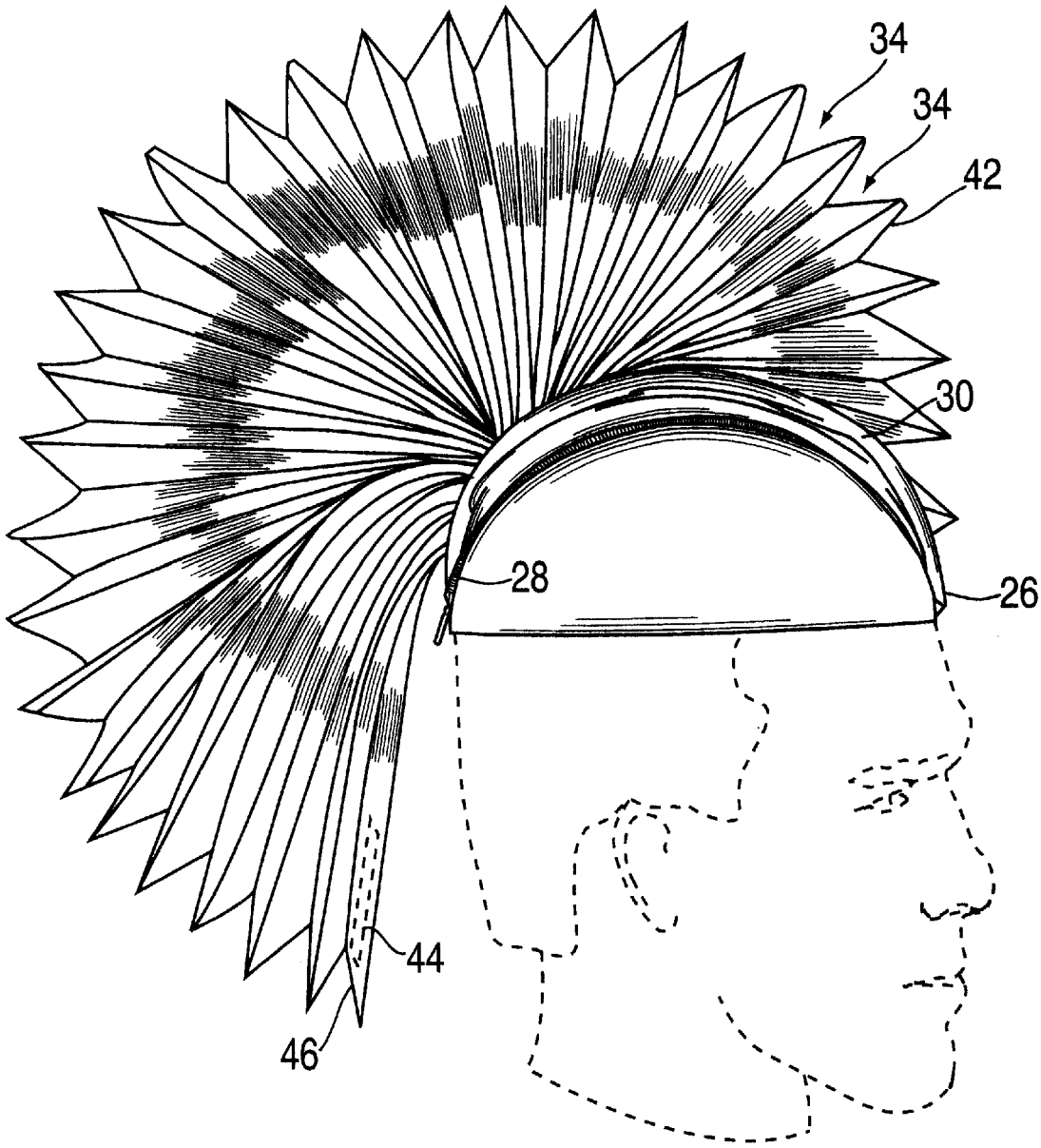
FIG. 4 is a side view of the fan-like structure in a fully open position on the head of a wearer.

Referring now to the drawings, there is shown in FIGS. 1 and 2, a dome-shaped cap designated as 10 having an open bottom 12 adapted to be worn on the head of a person as shown in FIGS. 3 and 4. The cap 10 may be made of suitable fabric and is defined by opposed sides or panels 14,16 which extend from the bottom of the cap toward the top thereof. Each side or panel 14,16 has a top foldable portion 18,20 which may be flipped outward or inward and may be opened and closed by a closing means such as the zipper 22. The foldable portions 18,20 are pliable and when the cap is mounted on top of the head, the foldable portions 18,20 conform to the dome-shaped cap. In the embodiment shown in FIGS. 2 and 5 the foldable portions 18,20 are separated by the ridge portion 24 which extends from the front end 26 to the rear end 28 of the cap, and is secured, e.g., by stitching, along its respective inner edges to the inner edges of the foldable portions 18,20. A pliable strip 30 made of suitable fabric is secured on the ridge portion 24 and extends substantially along the length of said ridge from the front end 26 to the rear end 28 of the cap. The strip 30 has an adherent bottom surface for attachment to the ridge portion 24 and a top Velcro® surface for engagement with the fan-like structure as hereinafter described.

Figure 5:
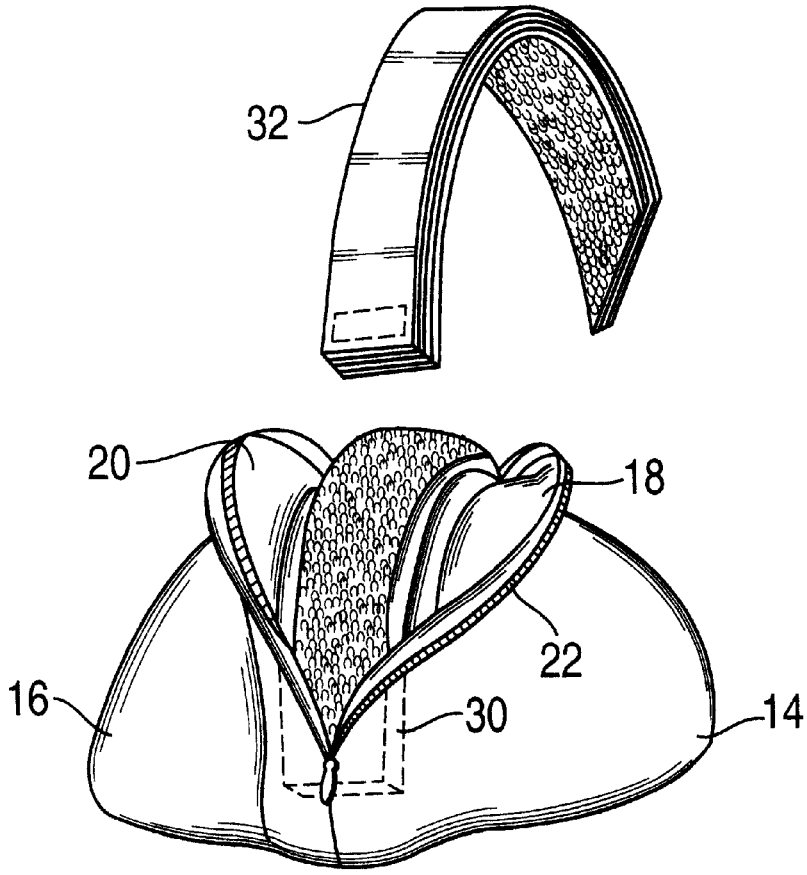
FIG. 5 is a perspective, partly exploded view of the cap shown in FIG. 2 illustrating the manner of attachment of the fan-like structure to the top of the head of the wearer.
Figure 6:
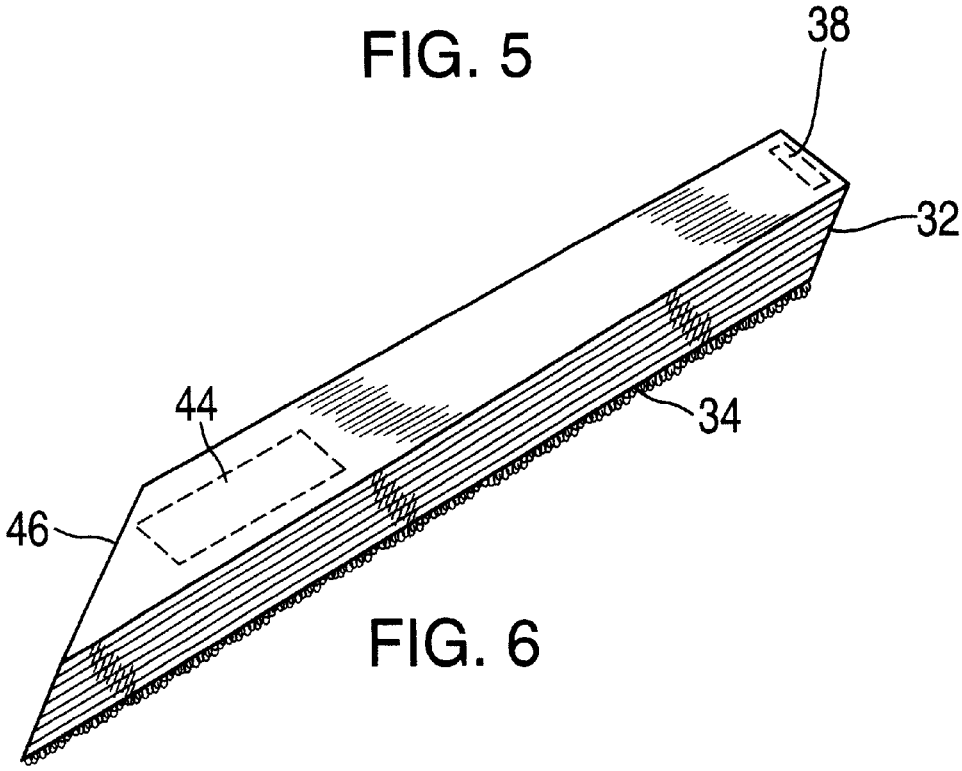
FIG. 6 is a perspective view of the accordion-shape fan-like structure in closed position with weight attached to the bottom most fin of the fan-like structure.

The fan-like structure used in the novel cap of the present invention is shown in FIGS. 3, 4 and 6. As shown therein a strip 32 of accordion folding 34 formed of a plurality of pleated fins 36 is mounted on the dome-shaped cap 10. The strip 32 is attached to the frontmost fin 36A and has one surface which is adhesively attached, e.g., glued, to the surface of the fin 36A, and has a Velcro® surface which engages the corresponding Velcro® surface of the strip 30 mounted on the ridge portion 24 as aforesaid. The strips 30 and 32 are preferably coextensive in length and are sufficiently pliable for mounting on the dome-shaped cap to be conformally attached thereon as shown in FIG. 5. The fan-like structure 34 is formed of a plurality of fins 36 which are stacked atop each other as shown in FIG. 6. At the rear end 28, the fins are clasped or sewn together as in 38, while at the top ends the fins are pleated as in 42.

FIG. 5 illustrates the fan-like structure mounted on the cap with the accordion folding open to a nearly halfway position. As a practical matter, when the head is flipped backward, the fan-like structure will be open, and remain fully opened, as shown in FIG. 4, by means of a weight, usually in the form of a metal bar 44 placed in a pocket 46 in the bottom most fin 36B of the accordion-like pleated fin structure.

As it can be seen from the foregoing description and FIGS. 3 and 4, the wearer can simply rock or flip his or her head back to open the fan-like structure and the fan-like structure thus remains fully open by the weighted fin at the rear end of the accordion-like structure. In order to close the fan-like accordion structure, it may be flipped forward by hand or by a forward rocking motion.

While the cap has been illustrated and described with reference to a specific construction, it can be understood that it can assume other shapes and configurations, yet the fan-like structure may nevertheless be mounted thereof for the same purpose and with the same entertaining and marketing values. For example, the fan-like structure may be shaped by cutting the tips of the fin-like member to form a semi-circular, arched or even a flat shape, if desired. In addition, the fan-like structure may have various slogans or other indicia printed thereon which become visible when the fan-like structure is in open position.

If desired the cap with the fan-like structure mounted thereon can be used in combination with a face mask, which can by simply attached to the cap. Also, the fan-like structure may be mounted on backpack or a bag provided with sewn in zip pocket which serves to releasably hold the fan-like structure and which can be opened and closed by bending backward to open the fan and then forward to return it to its closed position with or without the use of the hands. The cap with the fan-like structure may also be used with different articles of clothing with the same effect and appearance as herein described.

Other obvious modifications are obvious and are suggested from the foregoing detailed description.

What is claimed is:

1. A fan novelty device comprising:

(a) a dome-shaped body;

(b) a strip of pliable accordion folded, structure openable to a fan-like structure, said accordion folded structure comprising a plurality of fin-like members, including a bottom fin-like member, and a weight attached to said bottom fin-like member, and (c) means for attaching said strip of accordion folded structure to said dome-shaped body to allow opening said accordion folded structure into a fan-like structure.

2. The device according to claim 1 wherein said device is to be worn on the head and wherein said dome-shaped body is a cap shaped to be conformally mounted on and sit on the head of the wearer.

3. The device according to claim 1 wherein said cap has a front end and a rear end and said strip of pliable material is pivotally mounted at the end of said cap whereby said accordion folding is pivotable from a closed to open position to define a fan-like structure.

4. The device according to claim 2 wherein said cap has a front end and a rear end and said strip of pliable material is pivotally mounted at the end of said cap whereby said accordion folding is pivotable from a closed to open position to define a fan-like structure.

5. The device according to claim 1 wherein said device is mounted on the end of a writing instrument and wherein said dome-shaped body is an eraser attached on top of said writing instrument.

6. The device according to claim 2 wherein said cap is made of a fabric.

7. A fan novelty device comprising:

(a) a dome-shaped cap, said cap comprising a bottom opening for mounting said cap on the head of the wearer, a pair of opposed side walls extending from the bottom of said cap toward the top thereof each side wall having a top foldable portion, said top foldable portions being joined to a centrally disposed pliable strip of material along their respective lengths, said strip extending from the front to the rear of said cap, (b) a strip of pliable accordion folded, structure openable to a fan-like structure, said accordion folded structure comprising a plurality of fin-like members, including a bottom fin-like member, and a weight attached to said bottom fin member, and (c) means for attaching said strip of accordion folded structure to said dome-shaped body to allow opening said accordion folded structure into a fan-like structure.

8. The novelty device as in claim 7 wherein said top foldable portions are closed and opened by a closing means.

9. The novelty device as in claim 8 wherein said closing means is a zipper.

10. The novelty device as in claim 7 wherein said fin-like members are secured together at the rear end of said cap and pivotally attached at said end.

11. The novelty device as in claim 8 wherein said fin-like members are secured together at the rear end of said cap and pivotally attached at said end.

12. The novelty device as in claim 9 wherein said fin-like members are secured together at the rear end of said cap and pivotally attached at said end.

* * * * *